US006068553A

United States Patent [19]

Parker

[11] Patent Number: 6,068,553

[45] Date of Patent: May 30, 2000

[54] GAMING MACHINES

[76] Inventor: Alan Geoffrey Parker, Y-Fron, Peterson-Super-Ely, South Glamorgan CF5 6LZ, United Kingdom

[21] Appl. No.: 08/912,072

[22] Filed: Aug. 15, 1997

[51] Int. Cl.[7] ..... A63F 9/24

[52] U.S. Cl. ..... 463/27; 463/16; 463/20; 273/138.1

[58] Field of Search ..... 463/16–20, 1–6; 273/143 R, 138.1, 138.2, 138 A, 142 H, 142 HA

[56] References Cited

U.S. PATENT DOCUMENTS

| | | | |
|---|---|---|---|
| 4,837,728 | 6/1989 | Barrie et al. | 273/138 A |
| 5,397,125 | 3/1995 | Adams | 273/138 A |
| 5,564,700 | 10/1996 | Celona | 463/20 |
| 5,707,285 | 1/1998 | Place et al. | 463/12 |
| 5,919,088 | 12/1999 | Weiss | 463/16 |
| 5,947,820 | 9/1999 | Morro et al. | 463/16 |
| 5,997,401 | 12/1999 | Crawford | 463/20 |

*Primary Examiner*—Jessica J. Harrison
*Assistant Examiner*—John M. Hotaling, II
*Attorney, Agent, or Firm*—Young & Thompson

[57] ABSTRACT

A number of gaming machines, such as fruit machines, are linked through a common control unit to a display which shows to all the players of the machines a range of prizes. When there is a special win on any machine, a selection is made from those prizes and the chosen one awarded to the player. As the prizes are won, so those on offer reduce, but once a star prize, of greater value than any of the others, is awarded, the full range may be restored. There can also be treasure chest keys on the display, and a winner of a key can try to open a treasure chest for a jackpot win. With only one out of many keys that will work, a very large jackpot is possible, and the amount, and the number of keys still available, can be part of the display.

13 Claims, 1 Drawing Sheet

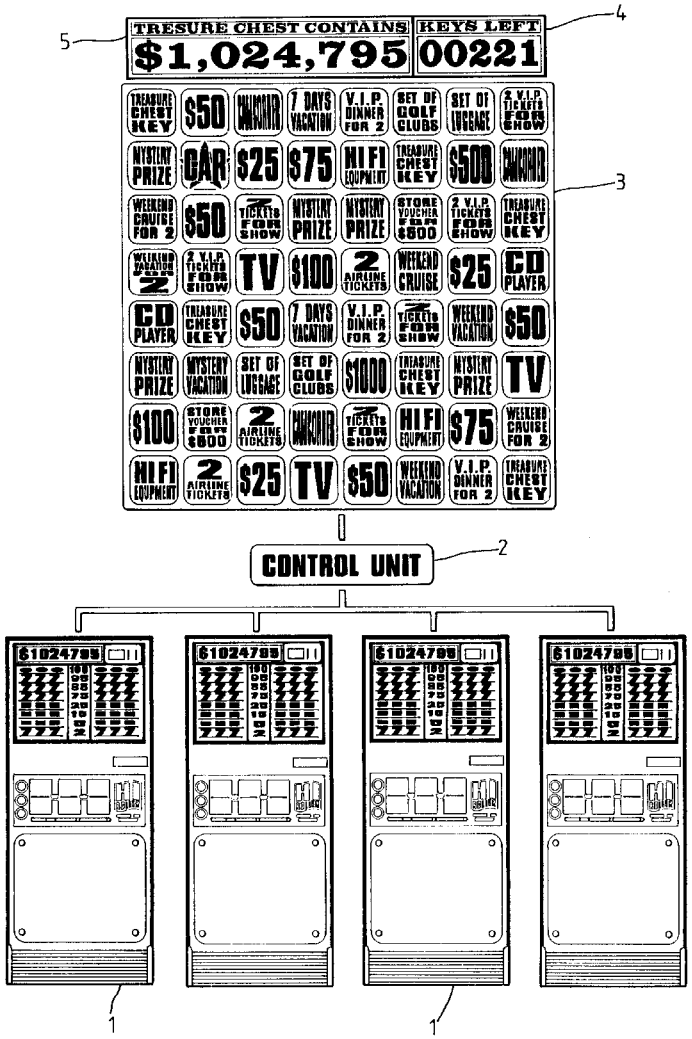

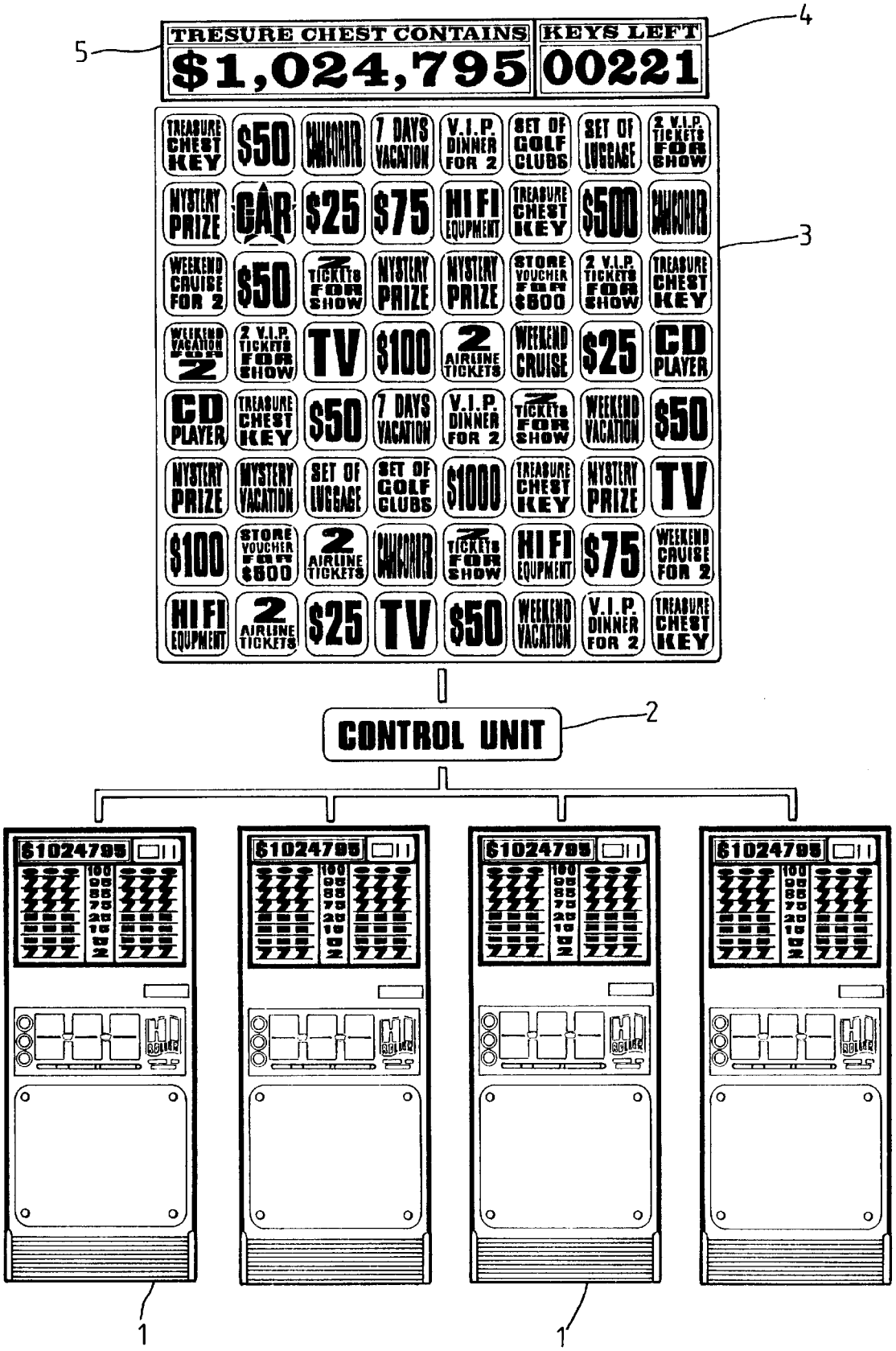
TRESURE CHEST CONTAINS
$1,024,795
KEYS LEFT
00221
5
4
3
TREASURE CHEST KEY
$50
CAMCORDER
7 DAYS VACATION
V.I.P. DINNER FOR 2
SET OF GOLF CLUBS
SET OF LUGGAGE
2 V.I.P. TICKETS FOR SHOW
MYSTERY PRIZE
CAR
$25
$75
HI FI EQUIPMENT
TREASURE CHEST KEY
$500
CAMCORDER
WEEKEND CRUISE FOR 2
$50
7 TICKETS FOR SHOW
MYSTERY PRIZE
MYSTERY PRIZE
STORE VOUCHER FOR $500
2 V.I.P. TICKETS FOR SHOW
TREASURE CHEST KEY
WEEKEND VACATION FOR 2
2 V.I.P. TICKETS FOR SHOW
TV
$100
2 AIRLINE TICKETS
WEEKEND CRUISE
$25
CD PLAYER
CD PLAYER
TREASURE CHEST KEY
$50
7 DAYS VACATION
V.I.P. DINNER FOR 2
7 TICKETS FOR SHOW
WEEKEND VACATION
$50
MYSTERY PRIZE
MYSTERY VACATION
SET OF LUGGAGE
SET OF GOLF CLUBS
$1000
TREASURE CHEST KEY
MYSTERY PRIZE
TV
$100
STORE VOUCHER FOR $500
2 AIRLINE TICKETS
CAMCORDER
7 TICKETS FOR SHOW
HI FI EQUIPMENT
$75
WEEKEND CRUISE FOR 2
HI FI EQUIPMENT
2 AIRLINE TICKETS
$25
TV
$50
WEEKEND VACATION
V.I.P. DINNER FOR 2
TREASURE CHEST KEY
CONTROL UNIT
2
$1024795
1
1

GAMING MACHINES

BACKGROUND OF THE INVENTION

This invention relates to gaming machines, and is concerned with a group of such machines linked together so that, while certain events may generate prizes awarded at the machine in question, a very rare event will generate an exceptional prize signalled at a common unit to which the machines are linked.

These very high jackpot wins are possible since they are funded by the income from a group of machines and not just by what has been put into the machine that has triggered the win. The principle is known and has been in practice for a number of years.

However, while the promise of a huge win is attractive, the odds against it happening are so great that they can almost be discouraging.

OBJECT OF THE INVENTION

It is the aim of this invention to make this grouped machine arrangement more appealing.

SUMMARY OF THE INVENTION

According to the present invention there is provided gaming apparatus comprising a group of individually playable gaming machines, a common prize control unit, a link between each machine and said unit, and a display responsive to said unit indicating a plurality of prizes, the arrangement being such that at least one special win on any machine triggers the control unit to select and award a prize from said display.

DETAILED DESCRIPTION OF THE INVENTION

The gaming machines may be of the fruit machine kind, but could be any machine that makes a random selection or at least a selection that has the appearance of being random. Generally, all the machines in a group will be of the same kind, so that, whichever one is played, there are the same odds on achieving a special win, which in turn generates a prize from the display.

While just one special win will be the norm, it could be arranged that two, or even more, special wins from each machine could trigger the control unit selection. However, by making it easier, the display prizes on offer could not be so great.

This does not preclude lesser prizes being awarded at the machines in the usual way when lesser wins than the special one are achieved.

It will be unusual for two or more machines to produce special wins simultaneously, or so close together that the prize selecting process resulting from one special win has not been completed before the next special win occurs. But it could happen, and the control unit may be programmed to organise a queue system, so that each display prize is issued in an orderly manner. To signal to the players what is happening, each machine may be equipped with an indicator such as a tower lamp, and these will be switched on in a coded manner through the respective links. For example:

(a) the machine with the first special win has its lamp flashed rapidly, (b) the machine with the second special win, next in line to have a special prize awarded from the display, has its lamp flashed slowly, (c) the machine with the third special win has its lamp on continuously.

If thought necessary, further characteristics could be adopted for those even later in the queue. As the machines move up the queue, so their indicator characteristics will change.

It would be possible simply to disable all the other machines temporarily when one delivers a special win, but that is not preferred.

The display may take various forms but the preferred one will be a television screen or a set of screens in a matrix. Thus, although for much of the time what is illustrated may be static and unchanging, there is the facility for changing the display and having moving graphics. In particular, it can show what is in any jackpot prize, and that may grow as the machines are played.

It is envisaged that the display will be in full view of the players of all the machines in a group and will be divided into areas, conveniently squares in grid form. Each area will show (or describe) a prize, and the same prize may be represented in several different areas. However, preferably there will be only one star prize, of a value considerably greater than any of the other prizes.

One or more areas may represent a treasure chest key which, if won, invites the winner to try to unlock a treasure chest (real or simulated). If the key does not fit, there will be no prize (or possibly only a small consolation one) , while if it does fit there will be a substantial jackpot prize. Generally there will be only one key that will work, but there could be a very limited number more than one.

Assuming a machine of the group produces a special win, this is signalled to the control unit, which then makes a selection from the display. Preferably, this is not instantaneous, but prolonged, with different areas being briefly distinguished, by extra brightness for example, until one particular area is settled upon and remains continuously bright. The prize so illuminated is then awarded.

With the treasure chest feature, there may be a given number of keys allocated at the outset, this number being shown on the display. As the keys are used up, failing one by one, so the number shown decrements. The smaller it becomes before the right key is found, the better the chance of the next player with a special win, and who then has the control unit select a treasure chest area, finding the key that opens the chest. With only one or a few treasure chest areas on the display and a large number of keys only one of which will work, the odds against winning the treasure can be enormous. Thus the treasure can be a very substantial jackpot and, furthermore, it may not be a static sum but increment progressively as the machines are played, the current amount being shown prominently on the display. The extra funds may come from an automatic percentage contribution from each coin entered into any of the machines, or it may be generated by separate side wagers that each machine is adapted to handle.

When a prize (other than the star prize) from the display area has been awarded, the selected area may then go blank, or be replaced by some non-prize representing graphics. The next selection will then be made from a reduced number of areas and so on. As this number decreases, so the chance of the star prize increases. But once that has been won, the display will reset.

Alternatively the selected areas may remain unchanged, so that all the prizes are always available.

It will be understood that there are other ways of indicating and selecting the special prizes, including a wheel or drum with the prizes illustrated around the periphery. This is spun in the manner of a wheel of fortune and when it stops the prize opposite a fixed pointer is awarded.

BRIEF DESCRIPTION OF THE DRAWING

For a better understanding of the invention one embodiment will now be described, by way of example, with reference to the accompanying drawing in which the single FIGURE is a diagram of gaming apparatus.

DETAILED DESCRIPTION OF THE DRAWING

The apparatus consists of a number of gaming machines 1 (four in this example, but there could be more or less) linked via a common control unit 2 to a display board 3. The gaming machines are all identical, but they may be of almost any kind. Typically they are "fruit machines", as illustrated.

The display 3 is an 8×8 matrix of screens, each showing a potential prize. Most prizes appear several times, but the large or star prize of a car (see position 2, 2) occurs only once. Above this matrix is an indicator 4 showing the number of keys left in the treasure chest feature explained above, and an indicator 5 showing the current value of the jackpot in the treasure chest. This amount is also shown on the individual machines 1.

A special win on any machine 1 triggers the control unit to make a random selection from the display matrix 3. The screens may separately lighten in an orderly or random manner over a period before the chosen one stays steadily illuminated. The prize associated with that screen is then claimed by the player of the machine with the special win.

Although the control unit 2 is shown as a separate item, it may not be physically separate from the display board. Alternatively, it could be incorporated in one of the machines 1, with the other machine linked to it.

What is claimed is:

1. Gaming apparatus comprising a group of individually playable gaming machines, a common prize control unit, a link between each machine and said unit, and a display responsive to said unit indicating a plurality of prizes distinct from any prize available from any said machine alone, the arrangement being such that at least one special win on any machine triggers the control unit randomly to select and award a prize from said display.

2. Gaming apparatus as claimed in claim 1, wherein all the machines of a group are of the same kind.

3. Gaming apparatus as claimed in claim 1, wherein the control unit is adapted, while making a prize selection generated by a special win on one machine, to register any special wins on other machines and to carry out further prize selections in sequence.

4. Gaming apparatus as claimed in claim 3, wherein there are indicator means on each machine to show that a special prize is being selected or that it is waiting to be selected following a special win on that machine.

5. Gaming apparatus as claimed in claim 1, wherein the display includes at least one treasure chest key area which, if selected by the control unit after a special win, gives the player achieving that win a choice of one from a plurality of keys with which to try to open a treasure chest, only a limited number of which keys will work, and wherein a key once tried is discarded leaving one fewer keys for the next player achieving a special win and being offered a choice of treasure chest keys.

6. Gaming apparatus as claimed in claim 5, wherein the number of treasure chest keys still available is shown on the display.

7. Gaming apparatus as claimed in claim 5, wherein the treasure chest contains a jackpot prize substantially greater in value than any other prize offered on the display.

8. Gaming apparatus as claimed in claim 7, wherein the amount of the jackpot is increased progressively as the machines are played.

9. Gaming apparatus as claimed in claim 8, wherein the amount of the jackpot is shown on the display.

10. Gaming apparatus as claimed in claim 1, wherein the display includes the indication of a star prize of substantially greater value than other prizes which, if selected, are guaranteed to produce a win.

11. Gaming apparatus as claimed in claim 1, wherein the display is variable and the control unit is adapted to remove from the display the representation of the prize it has selected following a special win, leaving fewer prizes from which to select when the next special win occurs.

12. Gaming apparatus as claimed in claim 11, wherein the control unit is adapted to restore to the display representations of all prizes previously removed once a particular prize has been won.

13. Gaming apparatus as claimed in claim 12, wherein the particular prize is a star prize of substantially greater value than other prizes which, if selected, are guaranteed to produce a win.

* * * * *